US010933659B2

(12) United States Patent
Rasmussen et al.

(10) Patent No.: US 10,933,659 B2
(45) Date of Patent: Mar. 2, 2021

(54) INKJET PRINT MEDIA CONDITIONER

(71) Applicant: Hewlett-Packard Development Company, L.P., Spring, TX (US)

(72) Inventors: Steve O Rasmussen, Vancouver, WA (US); Richard Lee Brinkly, Vancouver, WA (US); Jeffrey C Madsen, Boise, ID (US); Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 33 days.

(21) Appl. No.: 16/337,074

(22) PCT Filed: Oct. 5, 2016

(86) PCT No.: PCT/US2016/055474
§ 371 (c)(1),
(2) Date: Mar. 27, 2019

(87) PCT Pub. No.: WO2018/067137
PCT Pub. Date: Apr. 12, 2018

(65) Prior Publication Data
US 2020/0031143 A1 Jan. 30, 2020

(51) Int. Cl.
*B41J 11/00* (2006.01)
*B41J 2/02* (2006.01)
(Continued)

(52) U.S. Cl.
CPC ..... *B41J 11/0005* (2013.01); *B41J 2/03* (2013.01); *B41J 11/002* (2013.01);
(Continued)

(58) Field of Classification Search
CPC ..... B41J 11/0005; B41J 11/0015; B41J 2/03; B41J 11/002; B41J 2002/012; B41J 2002/022; B41J 2/475; B65H 2301/51212; B65H 2301/51256; B65H 2301/5143; B65H 2301/517; B65H 2404/147; B65H 2801/27; B65H 20/02; B65H 23/34
See application file for complete search history.

(56) References Cited

U.S. PATENT DOCUMENTS 6,272,310 B1 8/2001 Blair et al.
6,588,889 B2 7/2003 Jeanmaire
(Continued)

FOREIGN PATENT DOCUMENTS

| | | |
|---|---|---|
| EP | 1504914 | 2/2005 |
| EP | 3015271 | 5/2016 |
| JP | 2016-137584 | 8/2016 |

OTHER PUBLICATIONS

Paper Resource Center~Paper Storage and Conditioning, Jan. 21, 2004, https://www.xerox.com/printer-supplies/~2 pages.

*Primary Examiner* — Henok D Legesse
(74) *Attorney, Agent, or Firm* — Fabian VanCott

(57) ABSTRACT

An inkjet printing system may include an inkjet printing device, a print media finishing device, and a conditioner selectively coupled within a housing of the print media finishing device and in alignment with a print media exit of the inkjet printing device where the conditioner includes a number of heated pressure rollers to condition the print media prior to introduction into the print media finishing device.

13 Claims, 6 Drawing Sheets

(51) Int. Cl.
*B41J 2/03* (2006.01)
*B41J 2/01* (2006.01)

(52) U.S. Cl.
CPC ..... *B41J 11/0015* (2013.01); *B41J 2002/012* (2013.01); *B41J 2002/022* (2013.01)

(56) References Cited

U.S. PATENT DOCUMENTS

| | | | | |
|---|---|---|---|---|
| 6,601,840 | B2 | 8/2003 | Boss et al. | |
| 6,898,394 | B2 | 5/2005 | Schuller et al. | |
| 7,058,347 | B2 | 6/2006 | Uejima et al. | |
| 7,538,299 | B2 | 5/2009 | Spence et al. | |
| 7,721,744 | B2 | 5/2010 | Sabater Vilella | |
| 8,506,038 | B2 | 8/2013 | Mizes et al. | |
| 8,702,229 | B2 | 4/2014 | Ortmann et al. | |
| 9,227,429 | B1 | 1/2016 | LeStrange et al. | |
| 2011/0206841 | A1 | 8/2011 | Sabater Vilella | |
| 2014/0375729 | A1* | 12/2014 | Sunaoshi | B41J 2/17503 347/86 |
| 2016/0167403 | A1* | 6/2016 | Toya | F26B 17/284 347/102 |
| 2016/0273832 | A1* | 9/2016 | Asada | G03G 15/1695 |

* cited by examiner

INKJET PRINT MEDIA CONDITIONER

BACKGROUND

Inkjet printing devices create printed documents by ejecting an amount of printing fluid from a number of nozzles. The media onto which the printing fluid is ejected on may absorb the ejected printing fluid to form the image.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
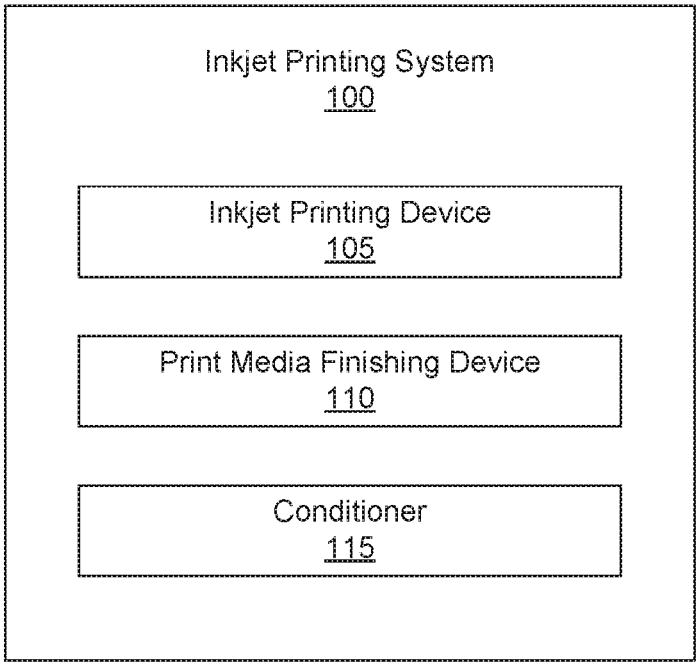
FIG. 1 is a block diagram of an inkjet printing system according to an example of the principles described herein.

As mentioned above, printing fluid is ejected onto a print media from an inkjet printing device. When the print media absorbs the printing fluid, however, the print media may be deformed or wrinkled as a result. In some situations, such a deformation may be tolerated. In these situations, a user may simply pick from an output tray of an inkjet printing device the printed sheets of print media. However, where after printing handling tasks are to be conducted on the print media, a paper handling device may be implemented.

In the later example, the paper handling device may subject a stack or a single sheet of print media to a number of post-printing processes such as a stapling process, a stamping process, a hole punching process, an embossing process, among other after-print processes. However, the deformed or wrinkled sheets of print media from the inkjet printing device are not conducive to reliable page registration in the paper handling accessory. Without proper registration of the print media, proper post-printing processes cannot be conducted without errors being present on the finished product.

The present specification therefore describes an inkjet printing system including an inkjet printing device, a print media finishing device, and a conditioner selectively coupled within a housing of the print media finishing device and in alignment with a print media exit of the inkjet printing device where the conditioner includes a number of heated pressure rollers to condition the print media prior to introduction into the print media finishing device.

The present specification also describes a modular print media conditioner that includes a fastening device to fasten the modular print media conditioner to an interior surface of a paper handling accessory and between the paper handling accessory and a printing device and a print media bypass to bypass a number of sheets of print media through the modular print media conditioner and to the paper handling accessory wherein the modular print media conditioner receives inkjet printed media from the inkjet printing device.

The present specification further describes a paper handling accessory including a print media conditioner selectively coupled to an interior surface of the paper handling accessory and comprising an inkjet printed media conditioning system wherein the print media conditioner receives inkjet printed media and wherein the print media conditioner provides conditioned inkjet print media to the paper handling accessory.

As used in the present specification and in the appended claims, the term "printing device" is meant to be understood as any device that applies an image to a sheet of print media. In an example, the printing device includes an inkjet printing device that ejects an amount of printing fluid onto a sheet of print media.

Additionally, as used in the present specification and in the appended claims, the term "a number of" or similar language is meant to be understood broadly as any positive number comprising 1 to infinity.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

Turning now to the figures, FIG. 1 is a block diagram of an inkjet printing system (100) according to an example of the principles described herein. The inkjet printing system (100) may be utilized in any data processing scenario including, as stand-alone hardware, implemented through a computing network, or combinations thereof. Further, access to the functions of the inkjet printing system (100) may be accomplished via a computing network, a public cloud network, a private cloud network, a hybrid cloud network, other forms of networks, or combinations thereof. In one example, the methods and functions provided by the inkjet printing system (100) are provided as a service over a network by, for example, a third party. In this example, the service may comprise, for example, the following: a Software as a Service (SaaS) hosting a number of applications; a Platform as a Service (PaaS) hosting a computing platform comprising, for example, operating systems; hardware, and storage, among others; an Infrastructure as a Service (IaaS) hosting equipment such as, for example, servers, storage components, network, and components, among others; application program interface (API) as a service (APIaaS), other forms of network services, or combinations thereof.

To achieve its desired functionality, the inkjet printing system (100) may include various hardware components. Among these hardware components may be a number of processors, a number of data storage devices, a number of peripheral device adapters, and a number of network adapters, among others. These hardware components may be interconnected through the use of a number of busses and/or network connections. In one example, the processor, data storage device, peripheral device adapters; and a network adapter may be communicatively coupled within the inkjet printing system (100) via a bus.

The processor may include the hardware architecture to retrieve executable code from the data storage device and execute the executable code. The executable code may, when executed by the processor, cause the processor to implement at least the functionality of sending instructions to a print media conditioner to condition a number of sheets of print media subsequent to an inkjet printing process, according to the methods of the present specification described herein. In the course of executing code, the processor may receive input from and provide output to a number of the remaining hardware units.

The data storage device may store data such as executable program code that is executed by the processor or other processing device. The data storage device may specifically store computer code representing a number of applications that the processor executes to implement at least the functionality described herein. The data storage device may include various types of memory modules, including volatile and nonvolatile memory. For example, the data storage device of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device as may suit a particular application of the principles described herein. In certain examples, different types of memory in the data storage device may be used for different data storage needs. For example, in certain examples the processor may execute program code stored in Random Access Memory (RAM).

Generally, the data storage device may comprise a computer readable medium, a computer readable storage medium, or a non-transitory computer readable medium, among others. For example, the data storage device may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The hardware adapters in the inkjet printing system (100) enable the processor to interface with various other hardware elements, external and internal to the inkjet printing system (100). For example, the peripheral device adapters may provide an interface to input/output devices, such as, for example, display device, a mouse, or a keyboard. The peripheral device adapters may also provide access to other external devices such as an external storage device, a number of network devices such as, for example, desktop computing devices, laptop computing devices, servers, switches, and routers, client devices, other types of computing devices, and combinations thereof.

A display device may be provided to allow a user of inkjet printing system (100) to interact with and implement the functionality of the inkjet printing system (100). The peripheral device adapters may also create an interface between the processor and the display device, the printing device of the inkjet printing system (100), or other media output devices. The network adapter may provide an interface to other computing devices within, for example, a network, thereby enabling the transmission of data between the inkjet printing system (100) and other devices located within the network.

The inkjet printing system (100) may, via the processor, display the number of graphical user interfaces (GUIs) on a display device on a printing device of the inkjet printing system (100) and associated with the executable program code representing the number of applications stored on the data storage device. Examples of display devices include a screen on the printing device of the inkjet printing system (100), a computer screen, a laptop screen, a mobile device screen, a personal digital assistant (PDA) screen, and a tablet screen, among other display devices.

The inkjet printing system (100) may further comprise a number of modules used in the implementation of the methods described herein. The various modules within the inkjet printing system (100) comprise executable program code that may be executed separately. In this example, the various modules may be stored as separate computer program products. In another example, the various modules within the inkjet printing system (100) may be combined within a number of computer program products; each computer program product comprising a number of the modules.

As described above, the inkjet printing system (100) may comprise an inkjet printing device (105), a print media finishing device (110), and a conditioner (115). Each of these devices may be communicatively coupled to one another in order to transfer data and instructions regarding how to handle, print, and/or finish a sheet of print media. Each of these devices will now be described in more detail.

The inkjet printing device (105) may be any type of printing device that jets or ejects an amount of printing fluid onto a sheet of print media. An inkjet printing device (105) may include thermal ejection devices and/or piezoelectric devise within a printhead to eject the printing fluid onto the print media. The printing fluid used by the inkjet printing device (105) may be any type of liquid printing fluid that is ejectable onto the print media. As mentioned above, this may result in the printing fluid being absorbed into the print media to some degree resulting in wrinkled or deformed sheets of print media being placed in a tray after a printing process. This results in sheets of print media that may be conditioned in order to make the sheets of print media capable of being handled by a print media finishing device (110).

The conditioner (115) of the present inkjet printing system (100) may provide that conditioning. The conditioner (115) may be communicatively coupled to the inkjet printing device (105). Additionally, an entrance point of the conditioner (115) may be aligned with a tray or a media advancement device associated with the inkjet printing device (105) in order to receive a number of sheets of printed print media for conditioning. In an example, the conditioner (115) may be placed within a housing of the inkjet printing device (105). In this example, a portion of the internal compartment of the inkjet printing device (105) may be reserved for additional devices such as the conditioner (115). In an example the conditioner (115) may be placed between the inkjet printing device (105) and the print media finishing device (110) and coupled to each using a number of fasteners. These fasteners may selectively secure the conditioner (115) to the print media finishing device (110) and inkjet printing device (105) allowing a user to gain access to either of the conditioner (115), print media finishing device (110), and/or inkjet printing device (105) when, for example, a paper is jammed within or between either of the devices. This allows a user to quickly access portions of the inkjet printing system (100) to address such concerns and then recouple the print media finishing device (110), inkjet printing device (105), and conditioner (115) together using the fasteners in order to begin or continue a printing process descried herein.

The conditioner (115) may comprise any number of rollers to receive and condition a number of sheets of print media. In an example the conditioner (115) includes a number of heated rollers that receive a sheet of print media and condition the sheet by pressing and heating the sheet. This may be done in order to return the sheet of print media into a flat surface as well as drive off an amount of liquid on the surface of the sheet leaving the pigment of the printing fluid on the sheet.

The conditioner (115) may further include a number of print media advancement rollers. The print media advancement rollers may advance any sheet of print media into the conditioner (115) into the heated rollers and out of an exit of the conditioner (115) and into a print media finishing device (110) described herein. The number, layout, and type of these print media advancement rollers may vary depending, at least, on the position of the heated rollers within the conditioner (115).

In an example, the heated rollers may be place generally even with a print media entrance and exit of the conditioner (115). This allows a sheet of printed print media to be received directly from a tray or print media advancement device of the inkjet printing device (105) by the heated rollers. In this example, the heated rollers are also even with a print media exit of the conditioner (115) such that the printed print media may advance directly to a print media entrance of the print media finishing device (110) after being conditioned by the conditioner (115). As will be describe in more detail below, the heated rollers of the conditioner (115) may be placed below or above in a number of configurations.

The print media finishing device (110) may be any type of finishing device that receives a number of sheets of printed print media and arranges and/or subjects the printed print media to a number of post-printing processes. As described above, these post-printing processes may include stapling, hole punching, embossing, stamping, and correlating among others.

Figure 2:
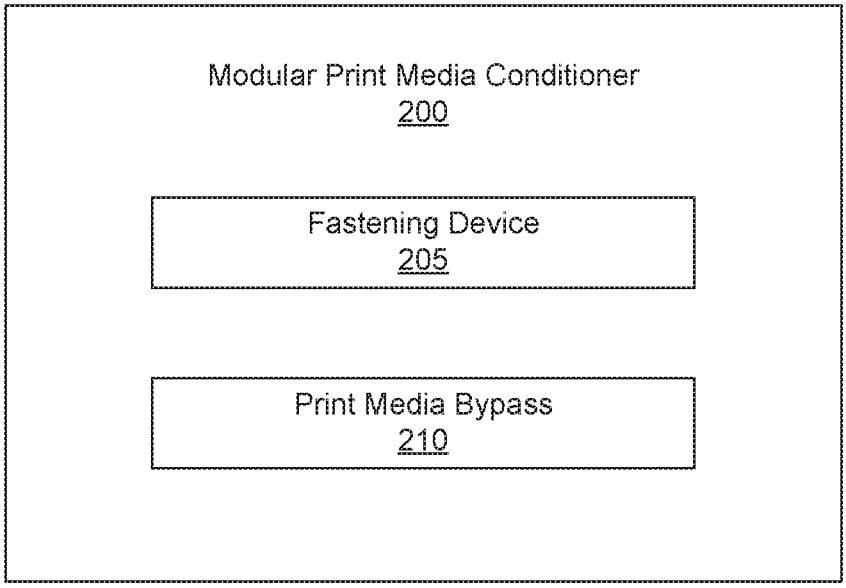
FIG. 2 is a block diagram of a modular print media conditioner according to one example of the principles described herein.

FIG. 2 is a block diagram of a modular print media conditioner (200) according to one example of the principles described herein. The modular print media conditioner (200) may comprise a fastening device (205), a print media bypass (210) and a number of heater rollers as described above. Each of these will be described in more detail below.

The fastening device (205) may include any device that couples the modular print media conditioner (200) to an inkjet printing device (FIG. 1, 105) and/or a print media finishing device (FIG. 1, 110). These fasteners may allow a user or operator of the modular print media conditioner (200) to separate the modular print media conditioner (200) from the inkjet printing device (FIG. 1, 105) and/or the print media finishing device (FIG. 1, 110). In an example, the fastening device may comprise a number of rails to which the modular print media conditioner (200) may be coupled on and cause the modular print media conditioner (200) to be placed interposed to the inkjet printing device (FIG. 1, 105) and print media finishing device (FIG. 1, 110) also coupled to the rails. In an example, the fasteners may include a screw that secures the modular print media conditioner (200) to an interior surface of the inkjet printing device (FIG. 1, 105) and/or print media finishing device (FIG. 1, 110). The fastening device (205) may also include other types of fasteners that allow for selective attached and detachment of the modular print media conditioner (200) to and from, respectively, the inkjet printing device (FIG. 1, 105) and/or print media finishing device (FIG. 1, 110).

As described above, the modular print media conditioner (200) may further include a number of heated rollers. The heated rollers, as described above, prepare the printed sheets of print media for receipt at the print media finishing device (FIG. 1, 110). In order to prepare the printed sheets of print media for the print media finishing device (FIG. 1, 110), the heated rollers iron out the wrinkles or deformations in the printed print media resulting from the print media absorbing the printing fluid. In an example, an amount of liquid in the printing fluid is also evaporated off when the printed print media comes in contact with the heated rollers.

The print media bypass (210) may be any device within the modular print media conditioner (200) that prevents a sheet of printed print media from coming in contact with a number of heated rollers. The print media bypass (210) may comprise a number of walls within the modular print media conditioner (200) that may selectively switch a media feed path from a first state that directs the print media to the heated rollers to a second state that directs the print media from the entrance of the media feed path in the modular print media conditioner (200) to an exit defined therein.

The above described processor of the inkjet printing device (FIG. 1, 105) of the inkjet printing system (FIG. 1, 100) may send instructions via the hardware connection to the modular print media conditioner (200) describing when the print media bypass (210) should switch from the first state to the second state. The processor may instruct the modular print media conditioner (200) to change the state of the print media bypass (210) based on a number of considerations. In an example, one consideration may include how much printing fluid was used to produce the image on each of the individual sheets of print media. In an example, a single sheet out of a number of sheets of print media within a print job may be bypassed from the heated rollers based on the relatively less amount of printing fluid used to form an image thereon. In this example, the print media bypass (210) may pause that sheet until other sheets have passed the heated rollers such that the order of printing each sheet of print media is maintained. In an example, one consideration that may be used to determine when a printed sheet of print media should be bypassed using the print media bypass (210) is what type of printing fluid was used to impart the image on that sheet of print media. In some examples, certain types or compositions of printing fluid may not cause as much or at least a tolerable amount of wrinkling or deformation in the print media such that the print media finishing device (FIG. 1, 110) can appropriately handle those printed sheets of print media. This information may be processed by the processor and used to determine when each sheet is to bypass the heated rollers by using the print media bypass (210). Other considerations may be taken into account in order to determine whether any single sheet of printed print media should be bypassed using the print media bypass (210) and the present specification contemplates those other considerations.

In an example, the heated rollers of the conditioner (115) may be placed below or above an exit of an inkjet printing device (FIG. 1, 105) and/or of an entrance of the print media finishing device (FIG. 1, 110). FIGS. 3A-3D are cross-sectional diagrams of a number of heater roller configurations according to a number of examples of the principles described herein. Each of these configurations may be described in terms of the modular print media conditioner (300) being placed within a housing of the print media finishing device (FIG. 1, 110). However, other configurations exist where the modular print media conditioner (300) is placed within a housing of the inkjet printing device (FIG. 1, 105) or as a separate modular device coupled to the inkjet printing device (FIG. 1, 105) and/or print media finishing device (FIG. 1, 110) described above and the present specification contemplates these other configurations.

Figure 3A:
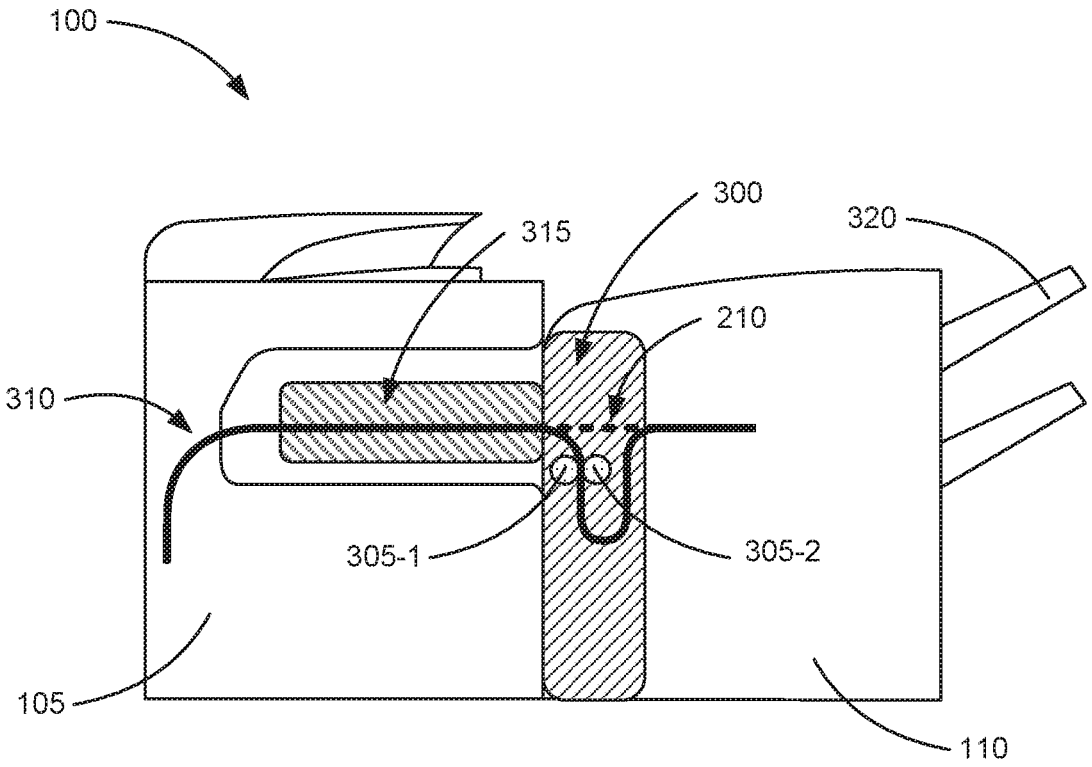
FIGS. 3A-3D are cross-sectional diagrams of a number of heater roller configurations according to a number of examples of the principles described herein.
Figure 3B:
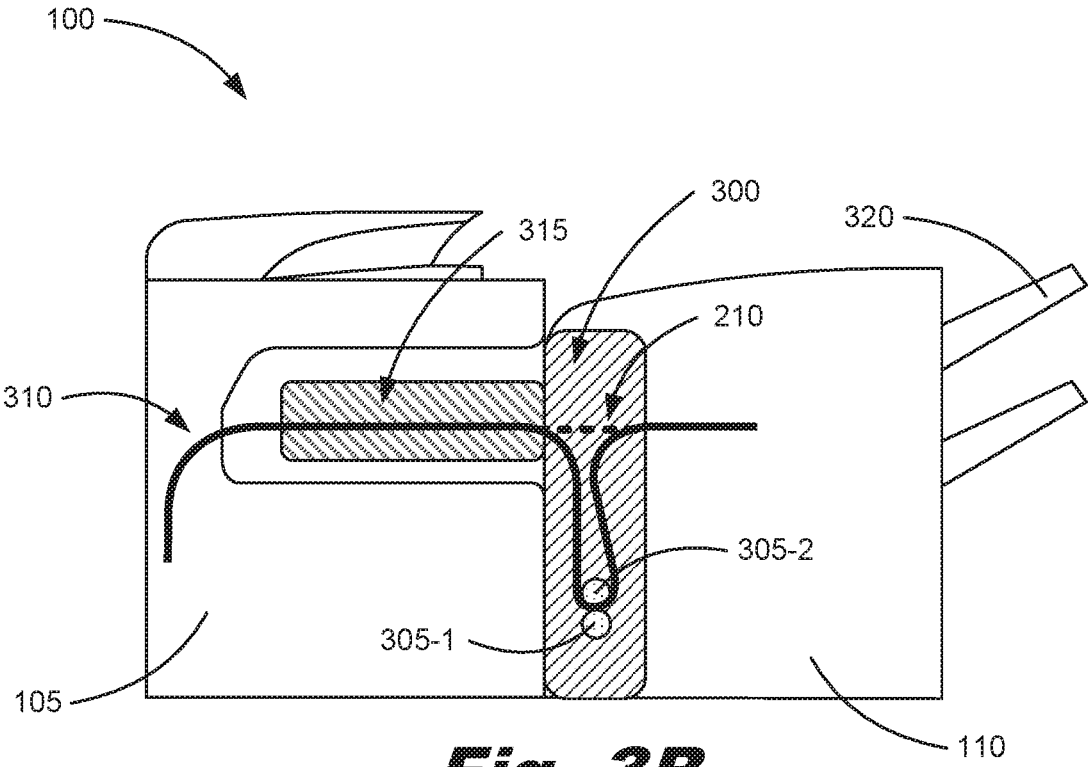
Figure 3C:
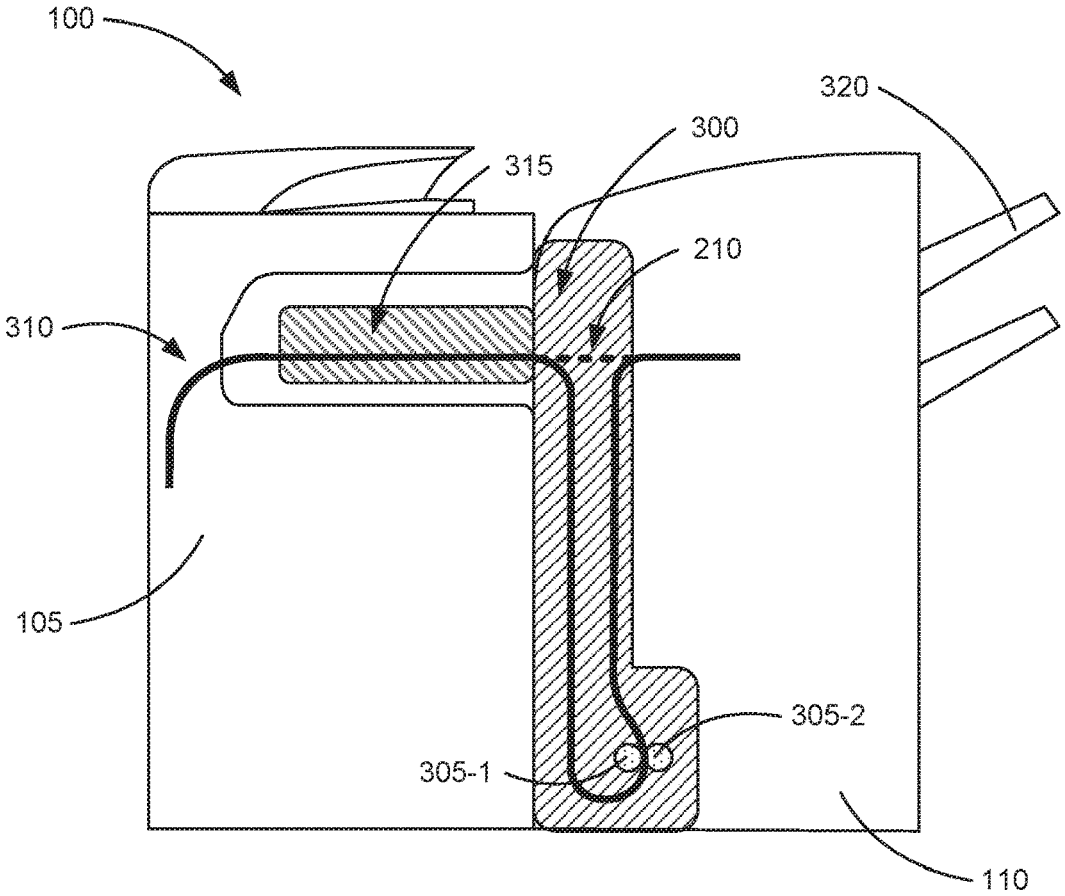
Figure 3D:
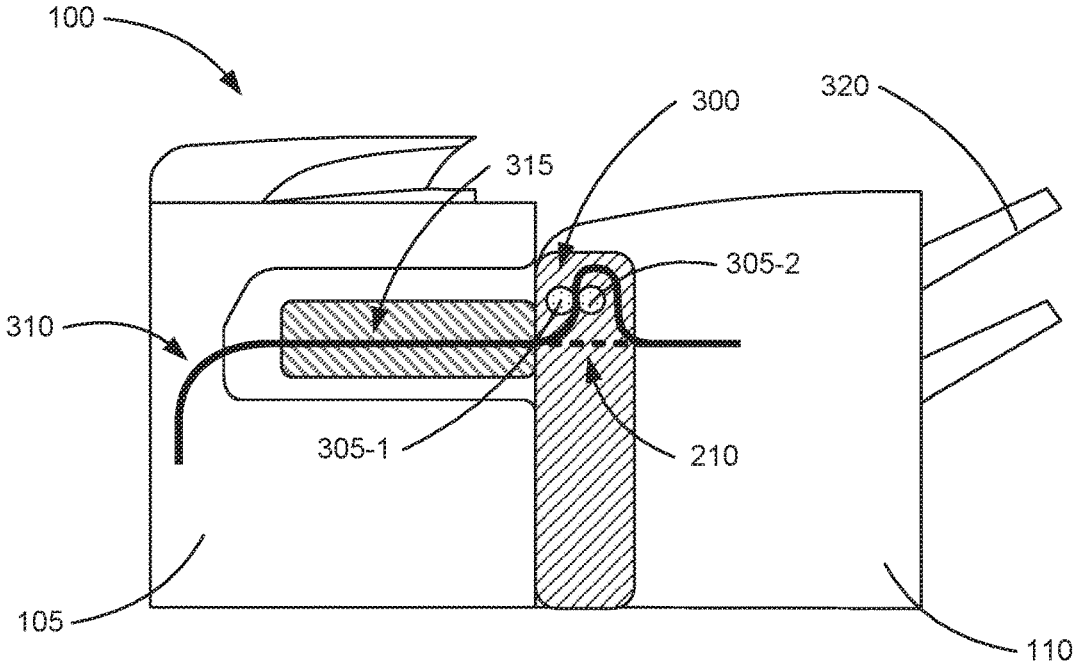

FIG. 3A is a cross-sectional diagram of an inkjet printing system (100) including an inkjet printing device (105), a print media finishing device (110), and a modular print media conditioner (300) as described above. The modular print media conditioner (300) may include a number of rollers (305-1, 305-2). Although FIG. 3A as well as FIGS. 3B-3D show two rollers (305-1, 305-2), any number of rollers may be implemented to at least transfer each sheet of print media through the modular print media conditioner (300) as described herein. In an example, a first roller (305-1) may be used to help pass a sheet of print media received from an inkjet printing device (105) while a second roller (305-2) serves as a heated roller. In an example, both the first (305-1) and second roller (305-2) may be heated rollers. As described above, the heated rollers condition a number of sheets of print media before directing those sheets of print media to a print media finishing device (110). In FIG. 3A as well as FIGS. 3B-3D, a media feed path is represented by a solid line (310). During operation, the inkjet printing device (105) of the inkjet printing system (100) may fulfill a print job by printing and image onto a number of sheets of print media. In an example, a media advancement device (315) may be used to advance the printed print media towards an entrance of the modular print media conditioner (300). In an example, the form of the inkjet printing device (105) may be such that a media advancement device (315) is not used because the printed print media has advanced enough from the inkjet printing device (FIG. 1, 105) to be fed directly into the modular print media conditioner (300). As the printed print media enters the entrance of the modular print media conditioner (300), a number of rollers and/or internal walls of the modular print media conditioner (300) may direct the printed print media towards the first roller (305-1) and second roller (305-2). As the printed print media passes between the first (305-1) and second roller (305-2), the printed print media is conditioned as described above. The now conditioned print media may be advanced further through the modular print media conditioner (300) towards and exit of the modular print media conditioner (300) and a similarly situated entrance to the print media finishing device (110). The print media finishing device (110) may then conduct any number of finishing processes on the now conditioned print media as described above.

During printing of any print media and/or print job, a sheet of printed print media from the inkjet printing device (105) may bypass the first (305-1) and second rollers (305-2) by using a print media bypass (210), As described above, the print media bypass (210) may prevent conditioning of any given sheet of printed print media by redirecting the printed sheet of print media through a portion of the modular print media conditioner (300) without engaging with the first (305-1) and second rollers (305-2). The print media bypass (210) may include any number of internal walls and/or rollers that redirect those given sheets of printed print media. As described above, any number of considerations may be taken into account in redirecting the printed print media and such redirection may be completed via signals provided by a processor in, for example, the inkjet printing device (105). After a finishing process has been conducted on the now conditioned print media by the print media finishing device (110), the printed and conditioned print media may be provided to an end user at, for example, a number of trays (320) associated with the print media finishing device (110).

The media feed path (310) within the modular print media conditioner (300) may be characterized as having a relatively short path with the first (305-1) and second rollers (305-2) being placed below the media feed path (310) within the inkjet printing device (105). This may reduce the physical space used to house the modular print media conditioner (300) within the print media finishing device (110). The U-shaped media path (310) within the modular print media conditioner (300) is included to provide a media path (310) of sufficient length to provide for an acceleration zone. The acceleration zone may be used to adjust the temporal length the printed and conditioned print media spends in the modular print media conditioner (300). This may accommodate for any lag within the print media finishing device (110) that may occur during a finishing process thereby preventing certain sheets of print media from overburdening the print media finishing device (110).

FIG. 3B is a cross-sectional diagram of an inkjet printing system (100) including an inkjet printing device (105), a print media finishing device (110), and a modular print media conditioner (300) as described above. Similar features and elements of the inkjet printing system (100) of FIG. 3B may exist as those described in FIG. 3A.

Thus, the modular print media conditioner (300) may include a number of rollers (305-1, 305-2). Any number of rollers may be implemented to at least transfer each sheet of print media through the modular print media conditioner (300) as described herein. In an example, a first roller (305-1) may be used to help pass a sheet of print media received from an inkjet printing device (105) while a second roller (305-2) serves as a heated roller. In an example, both the first (305-1) and second roller (305-2) may be heated rollers. As described above, the heated rollers condition a number of sheets of print media before directing those sheets of print media to a print media finishing device (110). Operation of the modular print media conditioner (300) may be similar to that described in connection with FIG. 3A above. In the example shown in FIG. 3B, the media feed path (310) may be characterized as having a relatively long path with the first (305-1) and second rollers (305-2) being placed below the media feed path (310) within the inkjet printing device (105). In the example shown in FIG. 3B, the first (305-1) and second rollers (305-2) are oriented vertically instead of horizontally as shown in FIG. 3A, The example shown in 3B, the U-shaped path angles away from the print media finishing device (110) on a return portion of the print media path (310). This may provide for additional space within the print media finishing device (110) that can be used in various ways. In an example, the acceleration zone created by the u-shaped path may be lengthened providing for relatively longer temporal space for a sheet of printed print media to be maintained in the modular print media conditioner (300) before being introduced into the print media finishing device (110). In an example, the print media finishing device (110) may be able to be shifted closer to the inkjet printing device (105) thereby reducing the overall desk-space or footprint of the inkjet printing system (100).

FIG. 3C is a cross-sectional diagram of an inkjet printing system (100) including an inkjet printing device (105), a print media finishing device (110), and a modular print media conditioner (300) as described above, Similar features and elements of the inkjet printing system (100) of FIG. 3C may exist as those described in FIGS. 3A and 3B.

Thus, the modular print media conditioner (300) may include a number of rollers (305-1, 305-2). Any number of rollers may be implemented to at least transfer each sheet of print media through the modular print media conditioner (300) as described herein. In an example, a first roller (305-1) may be used to help pass a sheet of print media received from an inkjet printing device (105) while a second roller (305-2) serves as a heated roller. In an example, both the first (305-1) and second roller (305-2) may be heated rollers. As described above, the heated rollers condition a number of sheets of print media before directing those sheets of print media to a print media finishing device (110). Operation of the modular print media conditioner (300) may be similar to that described in connection with FIG. 3A above.

In the example shown in FIG. 3C, the media feed path (310) may be characterized as having a relatively long path with the first (305-1) and second rollers (305-2) being placed below the media feed path (310) within the inkjet printing device (105). In the example shown in FIG. 3C, the first (305-1) and second rollers (305-2) are oriented horizontally instead of vertically as shown in FIG. 3B. In the example shown in 3C, the U-shaped path provides for additional space within the print media finishing device (110) that can be used in various ways. In an example, the acceleration zone created by the media path (310) in the modular print media conditioner (300) may be lengthened providing for relatively longer temporal space for a sheet of printed print media to be maintained in the modular print media conditioner (300) before being introduced into the print media finishing device (110). In an example, the print media finishing device (110) may be able to be shifted closer to the inkjet printing device (105) thereby reducing the overall desk-space or footprint of the inkjet printing system (100). Additionally, in this example, the first (305-1) and second rollers (305-2) may be located towards a lower area of the print media finishing device (110) where, in some print media finishing devices (110) unused space is available for implementation of this example. Thus the space between the inkjet printing device (105) and the print media finishing device (110) may be reduced because the modular print media conditioner (300) has been reduced in size.

FIG. 3D is a cross-sectional diagram of an inkjet printing system (100) including an inkjet printing device (105), a print media finishing device (110), and a modular print media conditioner (300) as described above. Similar features and elements of the inkjet printing system (100) of FIG. 3C may exist as those described in FIGS. 3A, 3B, and 3C.

Thus, the modular print media conditioner (300) may include a number of rollers (305-1, 305-2). Any number of rollers may be implemented to at least transfer each sheet of print media through the modular print media conditioner (300) as described herein. In an example, a first roller (305-1) may be used to help pass a sheet of print media received from an inkjet printing device (105) while a second roller (305-2) serves as a heated roller. In an example, both the first (305-1) and second roller (305-2) may be heated rollers. As described above, the heated rollers condition a number of sheets of print media before directing those sheets of print media to a print media finishing device (110). Operation of the modular print media conditioner (300) may be similar to that described in connection with FIG. 3A above.

In the example shown in FIG. 3D, the media feed path (310) may be characterized as having a relatively long path with the first (305-1) and second rollers (305-2) being placed above the media feed path (310) within the modular print media conditioner (300). In the example shown in FIG. 3D, the first (305-1) and second rollers (305-2) are oriented horizontally instead of vertically as shown in FIG. 3B. The example shown in 3D, the U-shaped path provides for additional space within the print media finishing device (110) that can be used in various ways. In an example, the acceleration zone created by the media path (310) in the modular print media conditioner (300) provides for relatively longer temporal space for a sheet of printed print media to be maintained in the modular print media conditioner (300) before being introduced into the print media finishing device (110). Additionally, with the U-shaped media path (310) above the first (305-1) and second rollers (305-2), an access door may be provided at the top of the modular print media conditioner (300) so as to provide access to the rollers (305-1 and 305-2) when a jam occurs in that location. Indeed, other configurations described above in connection with FIGS. 3A-3C may also include access doors at or around the location of the rollers (305-1, 305-2) so as to provide similar access in or around specified areas within the modular print media conditioner (300).

As mentioned above, the placement of the modular print media conditioner (300) within a housing of the print media finishing device (110) alleviates the need for making changes to the inkjet printing device (105) and print media finishing device (110). Additionally, the various examples above provide for a modular print media conditioner (300) that may be coupled with various configurations of print media finishing devices (110) and inkjet printing devices (105). Further, a user of the inkjet printing system (100) may selectively couple the modular print media conditioner (300) to either the interior of the inkjet printing device (105), the interior of the print media finishing device (110), the exterior of the inkjet printing device (105), and/or the exterior of the modular print media conditioner (300). This allows a user to remove the modular print media conditioner (300) when desired. Still further, inclusion of the modular print media conditioner (300) with the print media finishing device (110) and inkjet printing system (100) prevents jamming at least within the print media finishing device (110). This is the result of placing the print media conditioner (300) within the print media finishing device (110) thereby eliminating a relatively higher tolerance interface between the print media conditioner (300) and the print media finishing device (110). Additionally, by placing the print media conditioner (300) within the print media finishing device (110), the various access doors may be formed at the modular print media conditioner (300) allowing for relatively easier access to those places within the inkjet printing system (100) where jamming of printed print media often occurs.

Figure 4:
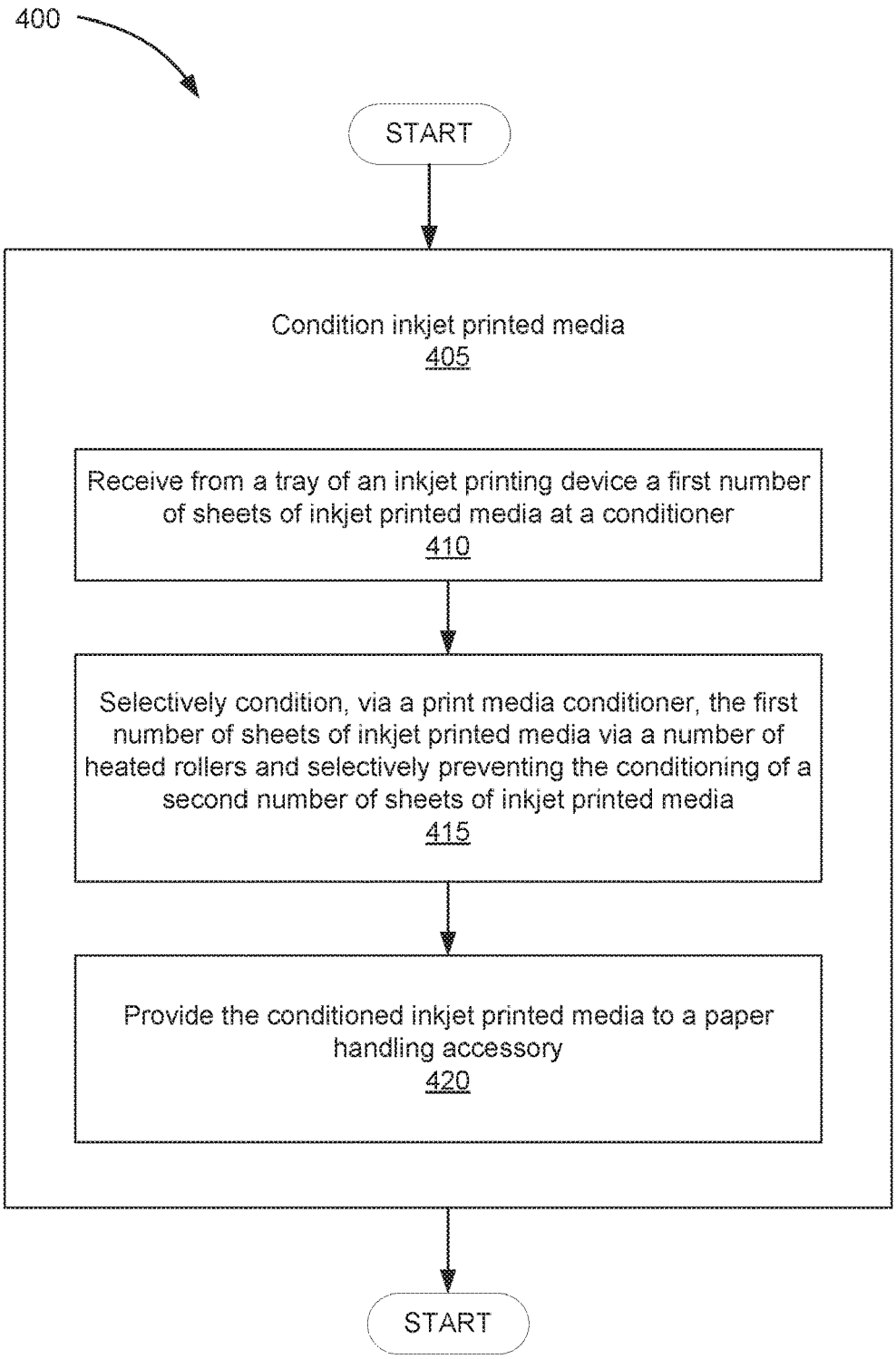
FIG. 4 is a flowchart showing a method of conditioning printed print media according to one example of the principles described herein.

FIG. 4 is a flowchart showing a method (400) of conditioning printed print media according to one example of the principles described herein. the method (400) may begin with conditioning (405) inkjet printed media by at least receiving (410) from a tray of an inkjet printing device a first number of sheets of inkjet printed media at a conditioner, selectively conditioning (415), via a print media conditioner, the first number of sheets of inkjet printed media via a number of heated rollers and selectively preventing the conditioning of a second number of sheets of inkjet printed media; and providing (420) the conditioned inkjet printed media to a paper handling accessory. Receiving (410) a first number of sheets of inkjet printed media at a conditioner may include actuating a media advancement device at the inkjet printing device (105) to advance the first number of sheets of inkjet printed media towards an inlet of the modular print media conditioner (300). In an example, the media advancement device may include a number of rollers.

Selective conditioning (415) of the first number of sheets of inkjet printed media is accomplished, in an example, via the use of a print media bypass (210) that selectively allows or prevents the first number of sheets of inkjet printed media from engaging with a number of heated rollers. As described above, the selective use of the print media bypass (210) is dependent on a number of factors as descried above. The processor of the inkjet printing device (105) may determine, based on those factors, when the print media bypass (210) should be activated or not.

The provision (420) of the conditioned inkjet printed media and the above mentioned first number of sheets of inkjet printed media to the print media finishing device (110) may be accomplished through a number of rollers or other print media transportative means that presents and advances the conditioned inkjet printed media at a print media inlet on the print media finishing device (110) from an outlet on the modular print media conditioner (300).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor of the inkjet printing device (105) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

Figure 5:
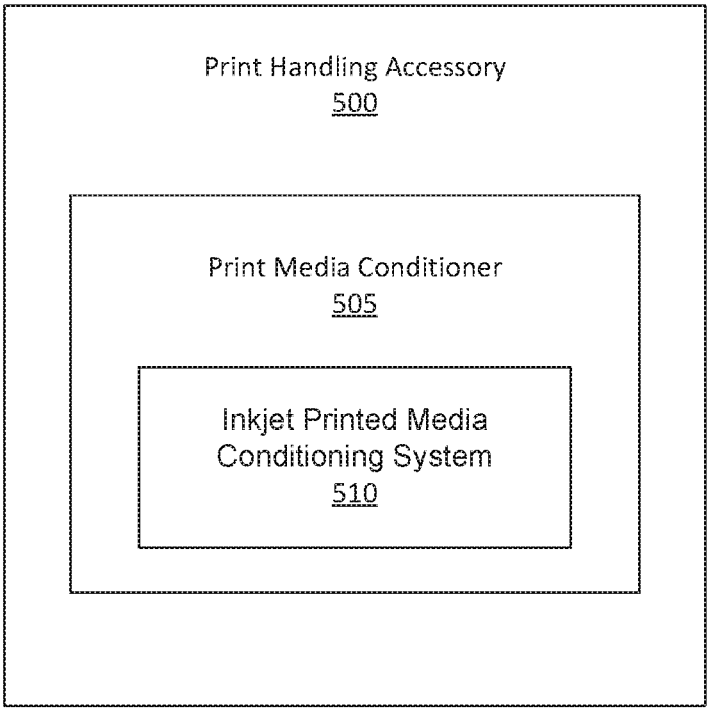
FIG. 5 is a block diagram of a print handling accessory (500) according to an example of the principles described herein.

FIG. 5 is a block diagram of a print handling accessory (500) according to an example of the principles described herein. The print handling accessory (500) may be any type of device that is capable of being selectively coupled to an inkjet printing device. An example of a print handling accessory (500) includes the above described print media finishing device (FIG. 1, 110) as well as other after-printing devices.

The print media finishing device (110) includes a print media conditioner (505) selectively coupled to an interior surface of the paper handling accessory (500) and including an inkjet printed media conditioning system (510). The print media conditioner (505) may be selectively coupled to the interior of the print handling accessory (500) by a number of screws or other type of fastener such that a user may remove the print media conditioner (505) from the print handling accessory (500). In an example, the print handling accessory (500) may include a door or hatch by which a user may access the print media conditioner (505) in order to service it or access it.

The inkjet printed media conditioning system (510) of the print media conditioner (505) may include, as described above, any number of rollers to pass inkjet printed media therethrough. A number of the rollers may be heated rollers used to condition the inkjet printed media as described above. This provides for a print handling accessory (500) that can better manage inkjet printed media after conditioning of that media at the print media conditioner (505). The inkjet printed media conditioning system (510) may further include an inkjet printed media bypass device that allows certain sheets of inkjet printed media to pass through the inkjet printed media conditioning system (510) without interfacing with the heated rollers or being subjected to conditioning.

The specification and figures describe an inkjet printing system (100) that includes a conditioner (115) to condition inkjet printed media before it is introduced into a print media finishing device (110). The placement of the modular print media conditioner (300) within a housing of the print media finishing device (110) alleviates the need for making changes to the inkjet printing device (105) and print media finishing device (110), Additionally, the various examples above provide for a modular print media conditioner (300) that may be coupled with various configurations of print media finishing devices (110) and inkjet printing devices (105), Further, a user of the inkjet printing system (100) may selectively couple the modular print media conditioner (300) to either the interior of the inkjet printing device (105), the interior of the print media finishing device (110), the exterior of the inkjet printing device (105), and/or the exterior of the modular print media conditioner (300). This allows a user to remove the modular print media conditioner (300) when desired. Still further, as described above, the inclusion of the modular print media conditioner (300) with the print media finishing device (110) and inkjet printing system (100) prevents jamming at least within the print media finishing device (110) and provision of various access doors at the modular print media conditioner (300) allow for relatively easier access to those places within the inkjet printing system (100) where jamming of printed print media often occurs.

The preceding description has been presented to illustrate and describe examples of the principles described. This description is not intended to be exhaustive or to limit these principles to any precise form disclosed. Many modifications and variations are possible in light of the above teaching.

What is claimed is:

1. An inkjet printing system, comprising:

an inkjet printing device;

a print media finishing device; and a conditioner selectively coupled within a housing of the print media finishing device and in alignment with a print media exit of the inkjet printing device, the conditioner comprising a number of heated pressure rollers to condition the print media prior to introduction into the print media finishing device, and wherein the conditioner comprises a print media bypass to selectively cause the print media to bypass the number of heated pressure rollers.

2. The inkjet printing system of claim 1, wherein the print media finishing device is selectively mounted to a housing of the inkjet printing device via a number of fasteners.

3. The inkjet printing system of claim 1, wherein the exit of the inkjet printing device further comprises a media advancement device to convey the print media from a tray of the inkjet printing device into a media feed path of the conditioner.

4. The inkjet printing system of claim 1, wherein the heated pressure rollers are located below the print media exit of the inkjet printing device.

5. The inkjet printing system of claim 1, wherein the heated pressure rollers are located above the print media exit of the inkjet printing device.

6. The inkjet printing system of claim 1, wherein the conditioner comprises an acceleration path to control the speed that the print media passes through the conditioner and into the print media finishing device.

7. The inkjet printing system of claim 1, wherein the print media bypass selectively causes the print media to bypass the number of heated pressure rollers based on a selection by a user of the printing device, a determination that a threshold amount of printing fluid was used to print an image on the print media, or combinations thereof.

8. A modular print media conditioner, comprising:

a fastening device to fasten the modular print media conditioner to an interior surface of a paper handling accessory and between the paper handling accessory and a printing device; and a print media bypass to bypass a number of sheets of print media through the modular print media conditioner and to the paper handling accessory;

wherein the modular print media conditioner receives inkjet printed media from the inkjet printing device.

9. The modular print media conditioner of claim 8, wherein the modular print media conditioner receives electrical power from at least one of the paper handling accessory and inkjet printing device.

10. The modular print media conditioner of claim 9, wherein the electrical power provides energy to a number of heater rollers and wherein the heater rollers receive the inkjet printed media and conditions the inkjet printed media prior to receipt by the paper handling accessory.

11. The modular print media conditioner of claim 8, further comprising:

an inkjet printed media feed slot positioned to receive from an output of the inkjet printing device the inkjet printed media; and an inkjet printed media outlet positioned to convey the inkjet printed media to an inkjet printed media inlet on the paper handling accessory.

12. The modular print media conditioner of claim 8, wherein the modular print media conditioner receives operative instructions from the inkjet printing device via a communicative cable to bypass the number of sheets of print media through the modular print media conditioner.

13. A paper handling accessory, comprising:

a print media conditioner selectively coupled to an interior surface of the paper handling accessory and comprising an inkjet printed media conditioning system;

wherein the print media conditioner receives inkjet printed media and wherein the print media conditioner provides conditioned inkjet printed media to the paper handling accessory, and further comprising a bypass structure defined in the print media conditioner to selectively bypass a number of sheets of inkjet printed media away from the inkjet printed media conditioning system.

* * * * *